United States Patent [19]

Davidson

[11] Patent Number: 4,958,459

[45] Date of Patent: Sep. 25, 1990

[54] LETTER LACE

[76] Inventor: Orlando D. Davidson, 409 Harrison Rd., Fredericksburg, Va. 22401

[21] Appl. No.: 293,974

[22] Filed: Jan. 6, 1989

[51] Int. Cl.[5] ..... G09F 23/00
[52] U.S. Cl. ..... 40/636; 36/136
[58] Field of Search ..... 40/636, 316; 36/136, 36/137

[56] References Cited

U.S. PATENT DOCUMENTS

| | | | |
|---|---|---|---|
| 4,254,566 | 3/1981 | Haskell | 40/636 |
| 4,268,986 | 5/1981 | Piana | 40/316 |
| 4,536,975 | 8/1985 | Harrell | 40/636 |
| 4,597,198 | 7/1986 | Schweitzer | 36/136 |

*Primary Examiner*—Gene Mancene
*Assistant Examiner*—Michael Lynch

[57] ABSTRACT

An attachment for shoe laces and the like that, singularly or when combined with a plurality of the same, is capable of displaying a decorative design or personalized message on a shoe.

7 Claims, 2 Drawing Sheets

LETTER LACE

BACKGROUND

In the tennis shoe industry, there have been many attempts over the years to make shoes more appealable to the comsumer. For this reason, various designs and shoes colors, with flamboyantly colored shoe laces and stitching, have been employed. However, none of these marketing strategies has provided a means for giving the consumer the flexibility in personalizing and/or creating his own decorative design on the shoe. The present invention provides a means to accomplish this end.

SUMMARY OF INVENTION

The objective of the present invention is to provide a decorative member adapted to be attached to shoe laces or the like. The member has a transverse opening extending therethrough to receive the lace and may, as an option, have a horizontal slit therein, cooperating with the opening, to permit insertion and/or removal of the attachment while the shoe is laced. Each attachment may have a graphic design, alphabet, and/or numeral character on a frontal surface thereof to singularly, or with an array of others, display a graphical design or personalized message.

A shoe lace that has been threaded through the shoe eyelets in a known manner to produce a series of horizontal lace lines provides the best mode for displaying a plurality of the attached members.

A further objective of the present invention is to provide a decorative attachment member that is economical and easy to produce.

THE DRAWINGS

DETAILED DESCRIPTION OF THE PREFERRED EMBODIMENTS

Figure 1:
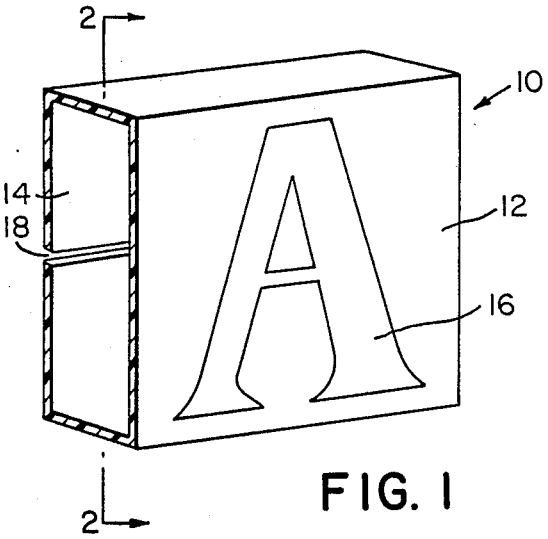
FIG. 1 is a perspective view of the instant invention.
Figure 2:
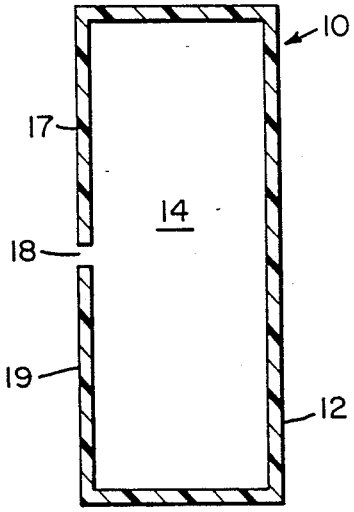
FIG. 2 is cross-sectional view of the instant invention shown in FIG. 1.
Figure 3:
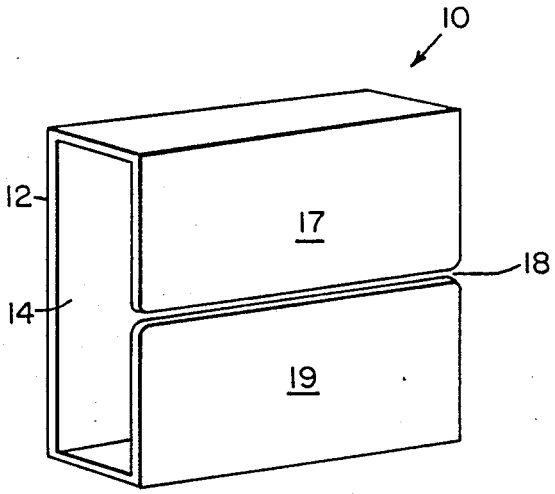
FIG. 3 is a rear perspective view of the instant invention.

Referring to the drawings, FIGS. 1–3 show a first preferred embodiment of the instant invention. The member (10) is comprised of an elongated tubular body member (12) having a longitudinal opening (14) therethrough. Member (12) is made of, although not limited to, a plastic meterial or the like.

On the frontal surface of member (12), an alpha and/or numeric character (16) is provided. The character (16) may be adhered to, embossed in, or otherwise applied to said frontal surface.

Figure 4:
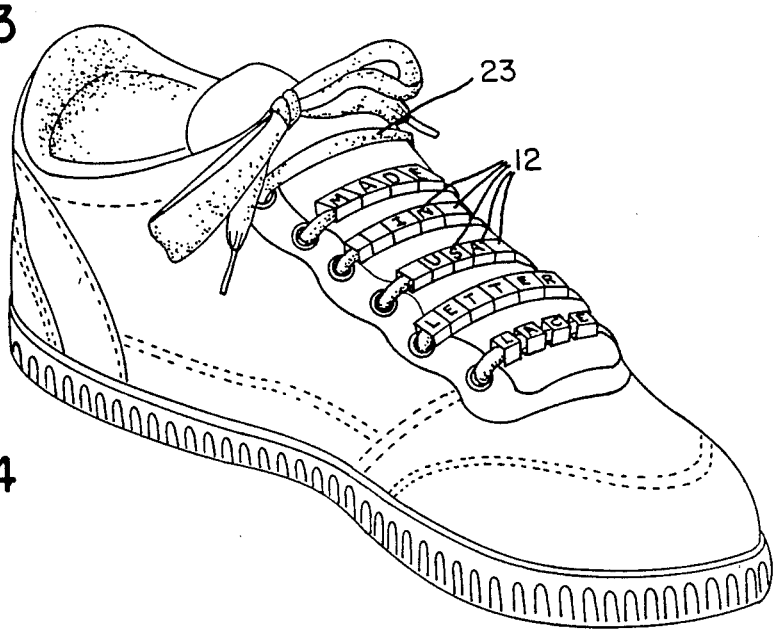
FIG. 4 shows an array of members comprising the instant invention in use on the threaded shoe lace of a conventional tennis shoe.
Figure 5:
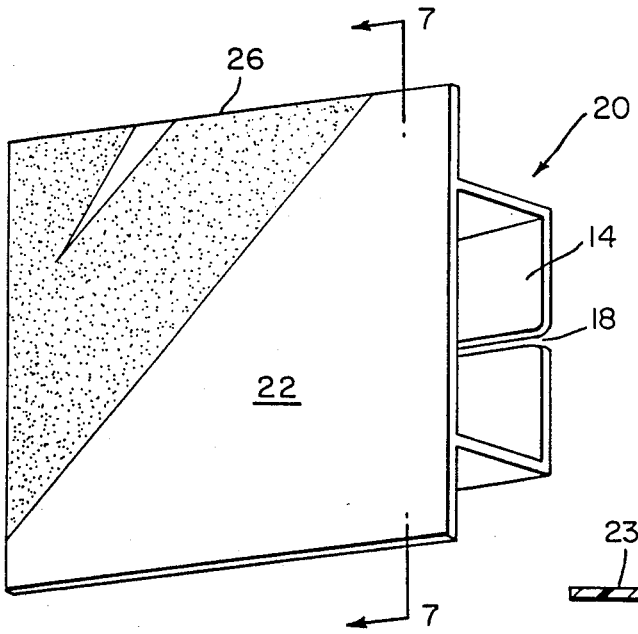
FIG. 5 is frontal view of an alternate embodiment of the instant invention.
Figure 7:
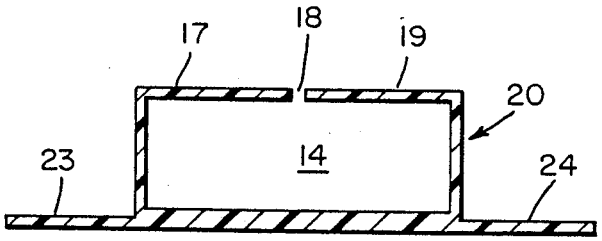
FIG. 7 is a cross-sectional view of the alternative embodiment of the instant invention shown in FIG. 5.
Figure 6:
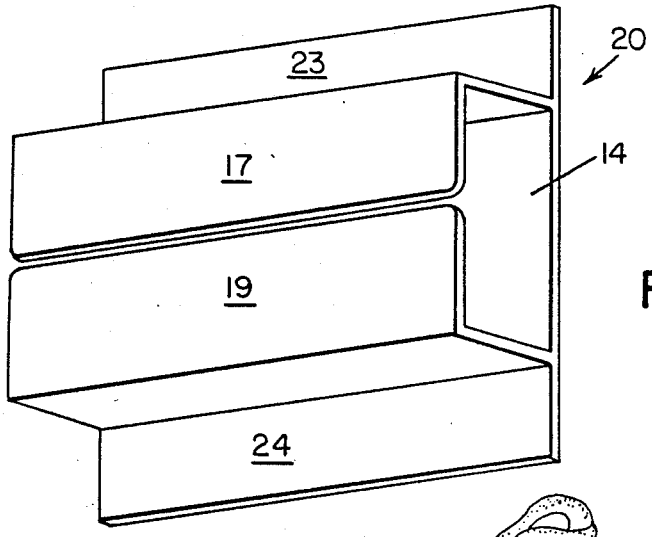
FIG. 6 is a rear view of the invention shown in FIG. 5.

On the rear surface of the body member (12), a longitudinal slit (18) is optionally provided. As shown in FIG. 3 the slit (18) divides the rear surface of body member (12) into upper and lower segments (17) and (19), as it cooperates with the longitudinal opening (14). As a result, the slit (18) allows the body member (12) to be inserted onto a shoe lace (23) that has been already threaded into the eyelets of a shoe (FIG. 4). The slit (18) may be optinally located in either the side or the frontal surface of the body member (12).

In use, as shown in FIG. 4, an array of body members (12) may be inserted, via slit (18), onto a threaded shoe lace (23) using a series of letters numbers to convey the personalized message desired by the user. Since slit (18) allows for the ease of insertion and removal of the body member (12) onto and from a threaded shoe lace, a user is afforded complete flexibility in changing the displayed message as desired.

Also as shown in FIG. 4, various ones of the body members (12) carrying no alpha or numeric characters thereon may be employed to represent blank spaces when needed.

Turning now of FIG. 5–8, an alternative embodiment of the instant invention is shown, wherein similar components to those shown in FIG. 1–4 are likewise labeled. The invention of the alternative embodiment comprises an elongated tubular body member (20) having a frontal surface (22) that extends laterally beyond both of the adjacent transverse side portions of the tubular body member. The results of these extensions provide for the opposite projections (23) and (24), which create an enlarged frontal surface area (22) for carrying a portion of a graphic design or message thereon.

Figure 8:
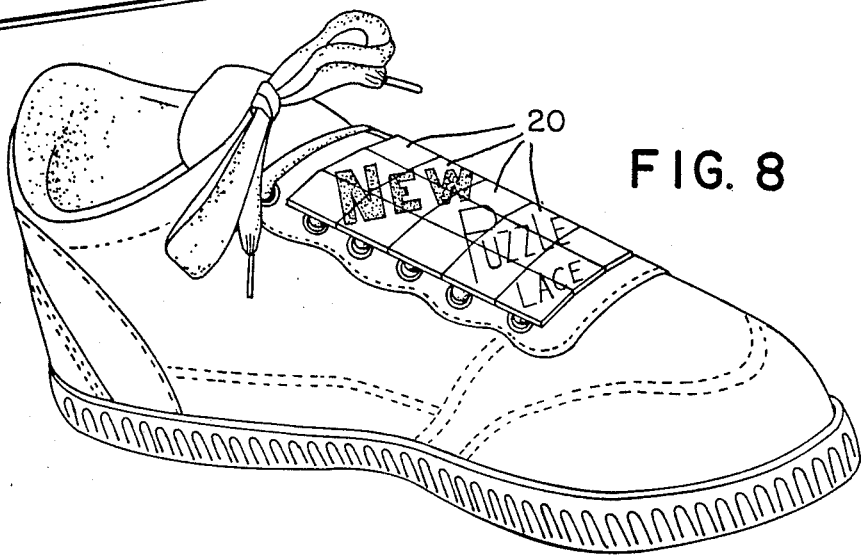
FIG. 8 shows a perspective view of an array of the alternative embodiment of FIG. 5 on a conventional shoe.

As shown in FIG. 8, when an array of members (20) are placed on a convention shoe lace, the graphic design or message portion carried by each is combined in a puzzle-like fashion to display a complete disign, picture, message, or the like.

While the drawings show at least two preferred embodiments of the instant invention, body members having various other shapes or types of material may be alternatively selected.

I claim:

1. An indicia carrying attachment comprising: an elongated, unitary body member having parallel frontal and rear surfaces joined by at least one pair of opposite transverse surfaces, longitudinal opening extending linearly through said body member having a configuration corresponding approximately to a shoe lace; indicia carried by said frontal surface; a longitudinal slit located in said rear surface and having a dimension approxiamte to the width of said lace; whereby said indicia carrying attachment may be selectively attached to said lace by sliding said lace edgewise through said slit, and thereafter rotating said attachment about said lace unitl said frontal surface is parallel with the horizontal plane of said lace.

2. For use with a shoe having a lace carried thereby, an indicia carrying attachment for interchangeably and variably displaying an unobstructed design or message on said shoe; said attachment comprising: a one-piece body member having a frontal surface, a longitudinal opening extending linearly through said member for receiving said lace, a slit located in said member and extending parallel to the longitudinal axis of said opening for permitting the selective attachment and removal of said member while said lace is tied or untied, and indicia carried on said frontal surface which when viewed is unobstructed by said lace when said attachment is installed thereon.

3. An indicia carrying attachment for use with a shoe lace; said attachment comprising: a unitary body member; an elongated opening for receiving said lace extending linearly through said body member and having a configuration corresponding approximately to said lace, whereby said body member is prevented from freely rotating on said lace; and a longitudinal slit in a surface of said body member cooperating with said enlongated opening to selectively permit the attachment and removal of said member to and from said lace, while said lace is threaded onto the shoe, with said lace being tied or untied.

4. The attachment in accordance with claim 3 wherein a graphic design, letter, numeral, or the like is provided on a surface of the member.

5. The attachment in accordance with claim 3, wherein a graphic design, letter, numeral, or the like is provided on a surface of the body member opposite to the surface having said longitudinal slit.

6. The attachment in accordance with claim 3, wherein the body member has a frontal surface, a rear surface, and a pair of transverse side surfaces connecting said frontal and rear surfaces, said frontal surface extending beyond said transverse side surfaces.

7. A method for interchangeably and variably displaying a graphical design or message on a shoe comprising the step of attaching one or more unitary body members carrying a graphic design, letter, numeral, or the like on a frontal surface thereof to a lace threaded on said shoe, said message being unobstructed by said lace; wherein said step of attaching comprises sliding said lace edge-wise through a slit in said body member until said lace is received into an elongated opening in the member, and thereafter rotating said lace and member relative to each other until the longitudinal planes of said lace and opening are substantially parallel.

* * * * *